United States Patent [19]

Linder

[11] Patent Number: 4,683,708

[45] Date of Patent: Aug. 4, 1987

[54] METHOD AND APPARATUS FOR WRAPPING PRINTED SHEETS

[75] Inventor: Heinz Linder, Zofingen, Switzerland

[73] Assignee: Grapha-Holding AG, Hergiswil, Switzerland

[21] Appl. No.: 833,330

[22] Filed: Feb. 25, 1986

[30] Foreign Application Priority Data

Mar. 15, 1985 [CH] Switzerland ..... 1172/85

[51] Int. Cl.[4] ..... B65B 11/50; B65B 35/50

[52] U.S. Cl. ..... 53/540; 53/168; 53/202; 53/553

[58] Field of Search ..... 53/586, 168, 447, 542, 53/553, 540, 202; 271/300; 414/48, 49, 86, 91

[56] References Cited

U.S. PATENT DOCUMENTS

| | | | |
|---|---|---|---|
| 3,343,334 | 9/1967 | Bode | 53/586 |
| 3,650,087 | 3/1972 | Brinkmeier | 53/528 |
| 3,683,758 | 8/1972 | Feldkamper | 414/91 X |
| 3,720,040 | 3/1973 | Rocker | 53/542 X |
| 3,849,968 | 11/1974 | Tateis | 53/540 X |
| 3,916,600 | 11/1975 | Falt | 53/168 X |
| 4,139,191 | 2/1979 | Mueller | 271/218 |
| 4,235,434 | 11/1980 | Mueller | 271/305 |
| 4,447,052 | 5/1984 | Mueller | 271/303 |
| 4,541,824 | 9/1985 | Mueller | 198/435 |

FOREIGN PATENT DOCUMENTS

| | | | |
|---|---|---|---|
| 2435232 | 2/1976 | Fed. Rep. of Germany | 53/540 |

*Primary Examiner*—John Sipos
*Attorney, Agent, or Firm*—Peter K. Kontler

[57] ABSTRACT

Partially overlapping printed sheets which are transported from an inserting or other producing or processing machine are delivered into a stacking unit which accumulates groups of overlapping sheets and dumps such groups into an intermittently operated wrapping unit wherein the groups are confined in plastic foils. The sheets which are intercepted during evacuation of a freshly formed group from the stacking unit are diverted into an accumulating unit which gathers the diverted sheets into piles and dumps the piles into a magazine for packing or for admission into one or more additional wrapping units.

3 Claims, 1 Drawing Figure

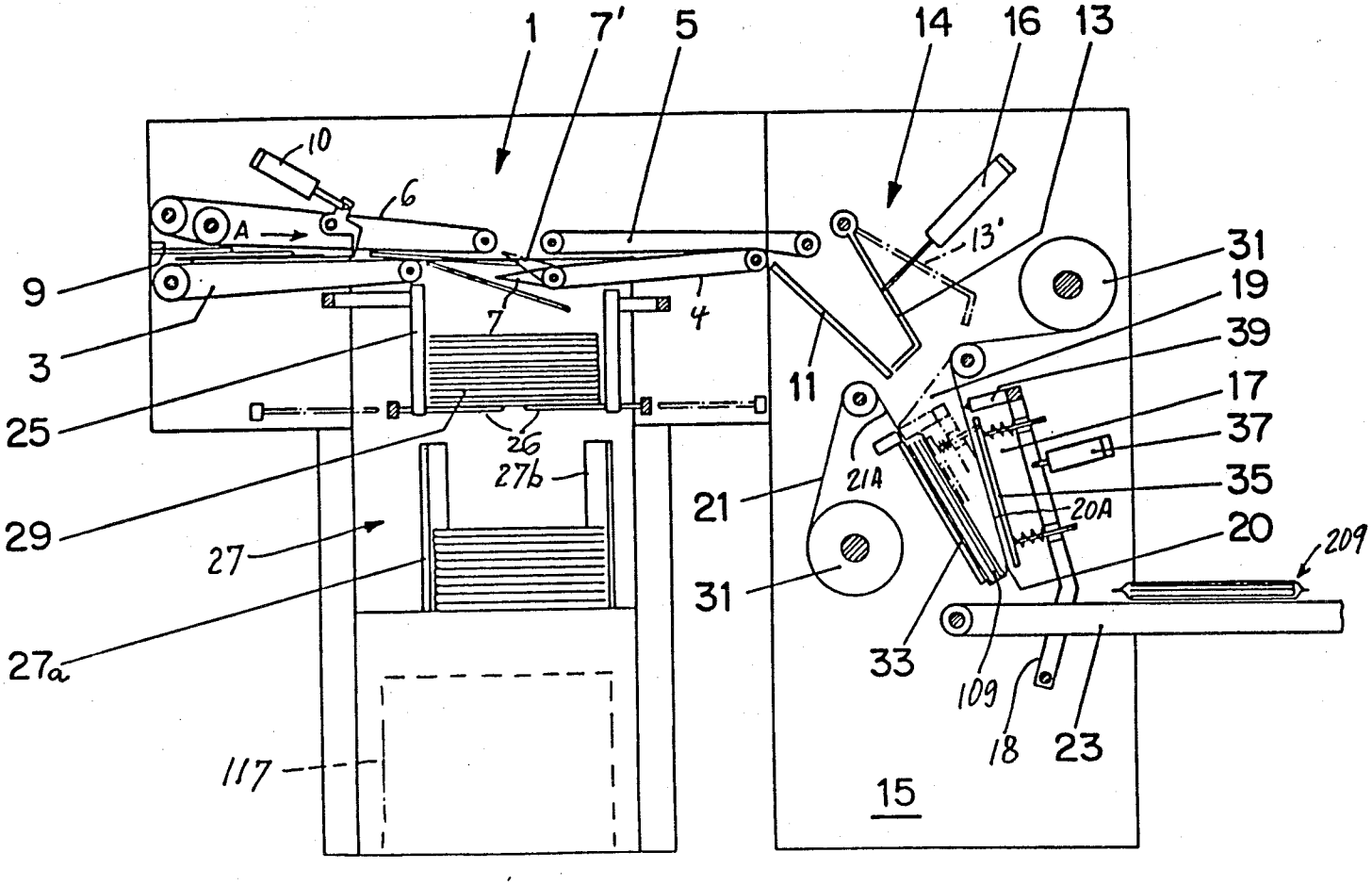
209
31
19
39
17
37
35
20
13
16
14
13'
20A
23
18
109
33
15
214
11
21
31
5
4
7'
1
7
26
27b
6
10
A
9
3
25
29
27
27a
117

METHOD AND APPARATUS FOR WRAPPING PRINTED SHEETS

BACKGROUND OF THE INVENTION

The invention relates to a method of and to an apparatus for manipulating sheets of paper or the like, especially for wrapping printed and folded sheets in a bookbinding, newspaper printing or like plant. More particularly, the invention relates to improvements in a method of and in an apparatus for confining individual sheets or groups of overlapping sheets in foils of plastic material or the like. Still more particularly, the invention relates to improvements in a method of and in an apparatus for confining groups of sheets between pairs of panels consisting of a light-transmitting or opaque weldable plastic material, especially between pairs of panels which form loops with bights ready to receive the leaders of successive groups of overlapping sheets.

It is often advisable and/or necessary to confine groups of sheets in transparent or translucent foils of synthetic plastic material. The wrapping machines which employ webs of such plastic material are often designed to loop a single web or strip of plastic material or to repeatedly unite the leaders of two webs so as to form a loop which is ready to receive the foremost group of a series of groups of overlapping sheets and to be thereupon converted into an envelope which preferably completely confines and seals a group from all sides.

A drawback of presently known wrapping machines of the just outlined character is that they cannot confine successive sheets or groups of sheets at the rate at which the sheets issue from a highspeed printing machine for the making of brochures, pamphlets, newspapers and similar products. The reason is that the wrapping machines (wherein groups of overlapping sheets are normally compressed, compacted or otherwise flattened prior to draping) operate intermittently whereas a printing machine can turn out continuously an extraordinarily large number of printed sheets or the like per unit of time. Therefore, if the printed products are to be wrapped in an intermittently wrapping machine, the printing machine which supplies the products must be operated at less than rated speed.

OBJECTS AND SUMMARY OF THE INVENTION

An object of the invention is to provide a novel and improved method of efficiently wrapping sheets which issue from a modern high-speed printing machine in available wrapping machines.

Another object of the invention is to provide a method which renders it possible to operate a high-speed printing machine at the rated speed without necessitating the operation of the wrapping machinery at a higher than normal or rated speed.

A further object of the invention is to provide a method which can be used with particular advantage for the wrapping of printed sheets in the form of piles, groups, stacks or like arrays of overlapping sheets prior to confinement in plastic foils or the like.

An additional object of the invention is to provide a method which renders it possible to utilize conventional wrapping machines in conjunction with ultramodern high-speed printing machines.

Still another object of the invention is to provide a novel and improved apparatus for effectively and predictably processing the output of a high-speed sheet printing machine.

A further object of the invention is to provide the apparatus with novel and improved means for regulating the delivery of sheets to one or more wrapping machines.

An additional object of the invention is to provide an apparatus whose components can simultaneously wrap the output of a high-speed printing machine at several locations in a small area and with commercially available wrapping machines.

Another object of the invention is to provide the apparatus with novel and improved means for orienting the sheets on their way toward as well as in a wrapping machine.

One feature of the present invention resides in the provision of a method of confining sheets between panels which are thereupon bonded (e.g., welded) to each other to sealingly surround the sheets. The method comprises the steps of transporting a succession of sheets along a predetermined path, stacking successive sheets into groups of overlapping sheets in a predetermined portion of the path, advancing the groups from the predetermined portion of the path, and wrapping the groups (preferably into light-transmitting plastic foils). The advancing step can include effecting the transfer of groups from the predetermined portion of the path by gravity feed.

The method preferably further comprises the steps of intermittently intercepting the sheets in a second portion of the path ahead of the predetermined portion, and diverting the intercepted sheets from the path. Each diverting step preferably follows a stacking step so that the sheets which would have advanced into the predetermined portion of the path during advancement of a freshly assembled group from the predetermined portion of the path are intercepted and prevented from travelling toward and actually reaching the predetermined portion of the path prior to evacuation of a freshly formed group from such path. The method preferably further comprises the step of accumulating the diverted sheets into piles (each such pile can but need not contain the same number of sheets as a group). Still further, such method can comprise the step of wrapping the piles, preferably in a second wrapping machine or unit which can be designed to place successive piles between pairs of light-transmitting plastic foils and to thereupon bond (preferably weld) the marginal portions of the foils to each other to thus completely confine and sealingly surround the piles.

Another feature of the invention resides in the provision of an apparatus for processing sheets. The apparatus comprises means for transporting a succession of sheets (e.g., a stream of partially overlapping sheets) along a predetermined path, stacking means for accumulating the oncoming sheets into a succession of groups or stacks in a predetermined portion of the path, means for effecting the advancement of successive groups from the predetermined portion of the path, and means for wrapping the advanced groups into foils. The wrapping means can comprise means for inserting successive groups between pairs of panels of weldable synthetic plastic material and means for bonding the panels to each other around the respective groups.

The stacking or accumulating means can be disposed at a level above the wrapping means, and the means which effects advancement of groups from the predetermined portion of the path can be designed to bring about gravitational descent of successive groups from the stacking means to the wrapping means. To this end, the stacking means can comprise a movable barrier and the means for effecting advancement of groups from the predetermined portion of the path can include means for moving the barrier from a normal position in the path immediately downstream of the predetermined portion to a position away from the path so that a freshly accumulated group of sheets can descend by gravity and enters the wrapping means. The wrapping means can include a ramp or other suitable means for maintaining the sheets of the groups in inclined positions (e.g., at angles of approximately 30 degrees with reference to a vertical plane).

The apparatus can further comprise conveyor means for wrapped groups of sheets, and such conveyor means can be disposed at a level below the wrapping means. The latter then preferably comprises means for discharging wrapped groups onto the conveyor means by gravity feed.

Still further, the apparatus can comprise means for diverting sheets from a second portion of the path ahead of the predetermined portion, and means for collecting or accumulating the diverted sheets. The collecting means can comprise means for accumulating piles of diverted sheets, and the apparatus can further comprise a magazine or other suitable means for receiving piles from the collecting means. The transporting means of such apparatus can comprise a first conveyor which serves to advance sheets to the second portion of the path and a second conveyor which serves to advance sheets from the second portion to the predetermined portion of the path. The diverting means of such apparatus can comprise a switching member which is movable (e.g., pivotable) between a first position in which the sheets leaving the first conveyor are free to advance toward and onto the second conveyor, and a second position in which the sheets leaving the first conveyor are directed into or toward the collecting means. The first conveyor can constitute an endless belt conveyor having a sheet-carrying upper reach which is preferably aligned or substantially in line with the sheet-carrying upper reach of a similar or analogous second conveyor. The collecting means can be provided with means for accumulating a succession of piles of overlapping sheets, and the apparatus can further comprise means for wrapping such piles into plastic foils or the like.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic partly elevational and partly vertical sectional view of an apparatus which embodies one form of the invention and employs two wrapping units.

DESCRIPTION OF THE PREFERRED EMBODIMENTS

The apparatus which is shown in the drawing comprises a sheet transporting unit 1 which advances a continuous or discontinuous stream of partially overlapping folded and imprinted paper sheets 9 along an elongated substantially horizontal path in the direction of arrow A. The transporting unit 1 can advance sheets 9 from a printing machine, from a folding machine, from an inserting machine, from a binding machine or from any other suitable source and comprises a first endless belt conveyor 3 whose upper reach advances the sheets 9 toward and normally onto the aligned or nearly aligned upper reach of a second endless belt conveyor 4. The conveyor 3 cooperates with an endless overhead belt conveyor 6 to define a substantially horizontal channel for the sheets 9, and the conveyor 4 cooperates with an analogous overhead belt conveyor 5 to advance the sheets 9 from the discharge end of the conveyor 3 toward and onto a downwardly sloping ramp 11 forming part of a sheet stacking or accumulating unit 14 and defining a predetermined portion of the aforementioned path, namely the portion wherein the sheets 9 are caused to fully overlap each other and to form a succession of stacks or groups 109 each containing a predetermined number of sheets 9.

The stacking unit 14 further comprises a substantially rake-like barrier 13 which is movable between an operative position, indicated by solid lines, and an inoperative or retracted position 13' in which it allows a freshly formed group 109 to descend by gravity feed and to enter a wrapping unit 17 therebelow. The suitably inclined free end portion of the barrier 13 can move all the way into contact with the upper side of the ramp 11 to predictably intercept the foremost sheet 9 of a series of sheets which are to be accumulated into a group 109 as well as to predictably intercept the second, third and additional sheets of a growing group.

The means for pivoting the barrier 13 between the operative and inoperative positions (and for thereby effecting gravitational descent of successive groups 109 into the wrapping unit 17) comprises a double-acting fluid-operated motor 16 whose cylinder is pivotably mounted in the frame 15 of the improved apparatus.

The wrapping unit 17 has an inlet 19 and comprises a ramp 33 whose inclination is similar to that of the ramp 11 and which ensures that the sheets 9 of successive groups 109 are inclined with reference to a vertical plane, e.g., through an angle of approximately 30 degrees. The ramp 33 further serves as a means for guiding or inserting the leaders of successive groups 109 into the spaces between successively assembled pairs of panels 20A, 21A preferably consisting of a light-transmitting weldable synthetic plastic material. The downwardly sloping ramp 33 further ensures that successively formed wrapped groups 209 can descend onto the upper reach of an endless belt conveyor 23 by gravity feed as soon as a freshly wrapped group 209 is ready to leave the wrapping unit 17. The conveyor 23 transports the wrapped groups 209 to storage, to a baling machine, to a carton filling machine or to any other destination, depending on the nature of sheets 9 which are confined in the plastic foils.

The wrapping unit 17 further comprises two sources 31 which constitute reels of convoluted light-transmitting plastic foil material in the form of elongated webs or strips 20, 21. The manner in which the webs 20, 21 are drawn off the respective reels 31 and the manner in which the leaders of such webs are secured to each other to form pairs of panels 20A, 21A which are ready to receive successively accumulated groups 109 is known and need not be described here. The wrapping unit 17 also comprises means for welding successive pairs of panels 20A, 21A to each other along the marginal portions of the respective groups 109. One welding or bonding device is shown at 39; this device is movable between the solid-line (retracted) position and an operative position (indicated by phantom lines) in which its heated tool or tools bond the adjacent portion of the web 20 to the web 21 along the upper marginal portion of the group 109 on the ramp 33. The group 109 on the ramp 33 is compressed or compacted by a spring-biased plate 35 which is mounted on a lever 18 carrying the springs for the plate 35 as well as the illustrated welding device 39. The means for pivoting the lever 18 relative to the frame 15 comprises a double-acting fluid-operated motor 37 whose cylinder is articulately connected to the frame 15.

Since the transporting unit 1 normally delivers sheets 9 at a rate exceeding the capacity of the intermittently operated wrapping unit 17, the apparatus further comprises a pivotable switching member 7 which is installed in the space between the conveyors 3, 4 and serves as a means for intercepting and diverting sheets 9 from a second portion of their normal path into a sheet accumulating or collecting unit 25 which accumulates piles 29 of accurately overlapping sheets 9 on two retractible gates 26 which are caused to dump successive piles into a magazine 27 which temporarily receives the piles 29 and can serve as a source of groups of sheets 9 for delivery to a second wrapping unit 117 (indicated schematically by broken lines). The unit 117 may not but need not be identical with or similar to the wrapping unit 17. The magazine 27 can also serve as a means for supplying piles or groups of sheets 9 to one or more packing machines, not shown. The packing machine or machines can be installed in, below or adjacent to the magazine 27.

The reference character 10 denotes a stop which can be actuated by a suitable sheet counter (not specifically shown) to lower its pallet into the path of movement of sheets 9 on the upper reach of the conveyor 3 and to temporarily interrupt the advancement of sheets toward and onto the switching member 7. When the last sheet 9 of a predetermined number of sheets has advanced toward and beyond the switching member 7 (i.e., when the conveyor 4 carries the last sheet or sheets 9 which are needed to accumulate a group 109 on the ramp 11 of the stacking unit 14), the pallet of the stop 10 is lifted and such movement of the pallet initiates, or takes place substantially simultaneously with, a movement of the switching member 7 from the solid-line position to the phantom-line position 7'. The oncoming sheets 9 are then diverted into the accumulating or collecting unit 25 which assembles a succession of piles. The switching member 7 is returned to the solid-line position as soon as the wrapping unit 14 is ready to receive a fresh series of sheets 9 which are to be stacked in order to form a group 109.

The magazine 27 can be turned through 180 degrees prior to each opening of the gates 26 so that successive piles 29 are assembled into a larger stack wherein a pile in which the folded backs of sheets 9 are adjacent to the left-hand sidewall 27*a* of the magazine 27 is disposed between a pair of piles wherein the folded backs of the sheets 9 are adjacent to the right-hand sidewall 27*b* and vice versa.

The operation of the motor 16 for the barrier 13 is synchronized with the operation of the motor for the pivotable switching member 7 so that the barrier 13 is compelled to move to the phantom-line position 13' as soon as the accumulation of a full group 109 of overlapping sheets 9 is completed. The thus released group 109 drops by gravity and enters the wrapping unit 17 via inlet 19. The manner in which a descending group 109 is arrested in such position that the lower marginal portion of the group is located in the bight of the loop which is formed by the panels 20A and 21A is not shown in the drawing. As mentioned above, the wrapping unit 17 may be of conventional design. The same applies for the wrapping unit or units 117 and for the packing machine or machines (if any) which receive sheets from the magazine 27.

The plate 35 and its motor 37 can be said to constitute a means for discharging successive wrapped groups 209 onto the conveyor 23 when the sealing of panels 20A, 21A around one, two or more marginal portions of the group 109 in the wrapping unit 17 is completed. The web or webs 20, 21 are drawn off the respective reels 31 upon completion of each wrapping operation in order to allow for the formation of a fresh loop whose panels 20A, 21A are ready to flank the two exposed major sides of a fresh group 109. The tool or tools of the welding device 39 sever the webs 20, 21 in the course of each welding or bonding operation.

As a rule, the number of sheets 9 which are diverted into the collecting unit 25 per unit of time exceeds (and can greatly exceed) the number of sheets 9 which enter the stacking unit 14 during the same unit of time. Therefore, the magazine 27 rapidly accumulates substantial numbers of stacked sheets which are then processed by one or more wrapping and/or packing units.

An important advantage of the improved apparatus is that it can utilize one or more readily available conventional wrapping units in conjunction with a transporting unit which delivers sheets at a rate well in excess of the number which can be processed in a single wrapping unit. Furthermore, the improved apparatus can simultaneously satisfy the requirements of two or more conventional wrapping units as well as the requirements of one or more wrapping units and one or more packing, baling or like units. The sheets which advance along the horizontal or nearly horizontal path (defined by the conveyors 3 and 4) and into the stacking unit 14 are treated gently and are accumulated into groups 109 in an optimum orientation for admission into the wrapping unit 17. The same applies for the sheets which are diverted by the switching member 7 so as to enter the accumulating or collecting unit 25.

Switching members which can be used in the apparatus of the present invention are disclosed in numerous patents of the assignee. Reference may be had, for example, to U.S. Pat. Nos. 4,235,434, 4,447,052 and 4,541,824. U.S. Pat. No. 4,235,434 further shows a sheet counter and a braking device or stop which can be used in the apparatus of the present invention. Stops with pallets upstream of pivotable switching devices are shown in U.S. Pat. No. 4,541,824. Commonly owned U.S. Pat. No. 4,139,191 shows retractible gates which can be used to dump piles of overlapping sheets into a magazine or the like. Many other component parts which are useful in the apparatus of the present invention are disclosed in additional United States and foreign patents of the assignee.

The wrapping unit 17 is preferably of the type known as SW 11 sold by K+J Maschinenfabrik Hjerting, DK-6700 Exbjerg, Denmark.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for processing sheets, comprising means for transporting a succession of sheets along a predetermined path; means for accumulating the oncoming sheets into a succession of groups in a predetermined portion of said path, said accumulating means including a movable barrier; means for effecting the advancement of successive groups from the predetermined portion of said path, including means for moving said barrier into and from said path downstream of said predetermined portion; means for wrapping the advanced groups into foils, including means for maintaining the sheets of the groups in inclined positions, means for inserting successive groups between pairs of panels of weldable synthetic plastic material, and means for bonding the panels to each other around the respective groups, said accumulating means being disposed at a level above said wrapping means and said advancement effecting means including means for effecting gravitational descent of groups from said accumulating means to said wrapping means; conveyor means for wrapped groups, said conveyor means being disposed at a level below said wrapping means and said wrapping means further comprising means for discharging wrapped groups onto said conveyor means by gravity feed; means for diverting sheets from a second portion of said path ahead of said predetermined portion; means collecting the diverted sheets, including means for accumulating a succession of piles of overlapping sheets; and means for wrapping such piles into foils, said transporting means comprising a first conveyor arranged to advance sheets to the second portion of said path and a second conveyor arranged to advance sheets from the second to the predetermined portion of said path, said diverting means including a switching member movable between a first position in which the sheets leaving said first conveyor are free to advance toward and onto said second conveyor, and a second position in which the sheets leaving said first conveyor are directed into said collecting means.

2. The apparatus of claim 1, wherein said collecting means comprises means for accumulating piles of diverted sheets, and further comprising means for receiving piles from said collecting means.

3. The apparatus of claim 1, wherein said second conveyor is aligned with said first conveyor.

* * * * *